US011346001B2

(12) United States Patent
Paesano

(10) Patent No.: US 11,346,001 B2
(45) Date of Patent: May 31, 2022

(54) DEPOSITING A STRUCTURALLY HARD, WEAR RESISTANT METAL COATING ONTO A SUBSTRATE

(71) Applicant: The Boeing Company, Chicago, IL (US)

(72) Inventor: Antonio Paesano, Wilmington, DE (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/863,614

(22) Filed: Apr. 30, 2020

(65) Prior Publication Data

US 2020/0255950 A1 Aug. 13, 2020

Related U.S. Application Data

(63) Continuation of application No. 15/688,337, filed on Aug. 28, 2017, now Pat. No. 10,787,743.

(51) Int. Cl.
*C23C 18/30* (2006.01)
*C23C 18/31* (2006.01)
(Continued)

(52) U.S. Cl.
CPC ..... *C23C 18/2073* (2013.01); *C23C 18/165* (2013.01); *C23C 18/1641* (2013.01);
(Continued)

(58) Field of Classification Search
CPC ..... C23C 18/2013; C23C 18/2073; C23C 18/285; C23C 18/30; C23C 18/31; C23C 28/023; C23C 28/322; C23C 18/1653
(Continued)

(56) References Cited

U.S. PATENT DOCUMENTS 3,639,143 A * 2/1972 Lussow ..... C03C 17/10 427/305
3,698,919 A * 10/1972 Kuzmik ..... C23C 18/28 106/1.11
(Continued)

FOREIGN PATENT DOCUMENTS

CN 1772950 A 5/2006
CN 103074648 A 5/2013
(Continued)

OTHER PUBLICATIONS

Mandich, "Surface Preparation of Metals Prior to Plating", AESF SUR/FIN 2002 Proceedings, p. 761-828, 2002.
(Continued)

*Primary Examiner* — Edna Wong
(74) *Attorney, Agent, or Firm* — McDonnell Boehnen Hulbert & Berghoff LLP

(57) ABSTRACT

An example method of coating a substrate involves cleaning the substrate and, after cleaning the substrate, sensitizing the substrate using a sensitizing solution including tin chloride and hydrochloric acid. The method also involves, after sensitizing the substrate, activating the substrate in an activating solution including palladium chloride and hydrochloric acid. Further, the method involves subsequently neutralizing the substrate using a neutralizing solution including ammonium hydroxide. Still further, the method involves, after neutralizing the substrate, depositing an electroless nickel layer on the substrate. The method may then involve depositing an electrolytic nickel layer on top of the electroless nickel layer, and depositing an outer layer of metallic material, ceramic material, polymeric material, or any combination thereof on top of the electrolytic nickel layer.

20 Claims, 6 Drawing Sheets

(51) Int. Cl.

| | |
|---|---|
| ***C23C 18/20*** | (2006.01) |
| ***C23C 18/16*** | (2006.01) |
| ***C23C 18/22*** | (2006.01) |
| ***C23C 18/32*** | (2006.01) |
| ***C25D 3/12*** | (2006.01) |
| ***C25D 5/54*** | (2006.01) |
| ***C23C 18/28*** | (2006.01) |

(52) U.S. Cl.
CPC ..... *C23C 18/1653* (2013.01); *C23C 18/208* (2013.01); *C23C 18/22* (2013.01); *C23C 18/285* (2013.01); *C23C 18/30* (2013.01); *C23C 18/32* (2013.01); *C25D 3/12* (2013.01); *C25D 5/54* (2013.01)

(58) Field of Classification Search
USPC ..... 205/167, 169, 187, 191, 195, 196
See application file for complete search history.

(56) References Cited

U.S. PATENT DOCUMENTS

| | | | | |
|---|---|---|---|---|
| 3,837,733 | A | | 9/1974 | Shoch et al. |
| 3,857,733 | A | | 12/1974 | Arnold |
| 4,042,730 | A | * | 8/1977 | Cohen ..... C23C 18/28 205/126 |
| 4,603,092 | A | | 7/1986 | Luch |
| 5,866,202 | A | | 2/1999 | Nastke et al. |
| 2015/0072070 | A1 | | 3/2015 | Saijo et al. |
| 2015/0075570 | A1 | | 3/2015 | Wu et al. |

FOREIGN PATENT DOCUMENTS

| | | | | | |
|---|---|---|---|---|---|
| GB | 1 158 699 | A | | 7/1969 | |
| JP | S53-006376 | A | | 1/1978 | |
| JP | 56025453 | A | | 3/1981 | |
| JP | 51082371 | A | * | 6/1981 | ..... C23C 18/16 |
| JP | S60-082674 | A | | 5/1985 | |
| JP | H06-240486 | A | | 8/1994 | |
| JP | H10-140362 | A | | 5/1998 | |
| JP | 2004-238731 | A | | 8/2004 | |
| JP | 2007-162037 | A | | 6/2007 | |
| JP | S39-029941 | | | 6/2007 | |
| JP | 2010-089335 | A | | 4/2010 | |
| PL | 118039 | B1 | * | 9/1981 | ..... C23C 3/00 |

OTHER PUBLICATIONS

Nickel Plating Handbook, Nickel Institute, 2014.
Woodford, Chris, "How electroplating works", available at http://www.explainthatstuff.com/electroplating.html, Jul. 19, 2017.
Extended European Search Report prepared by the European Patent Office in Application No. 18189627.5 dated Nov. 7, 2018.
Non-Final Office Action received for U.S. Appl. No. 15/688,337, dated Aug. 27, 2019,16 pages.
Final Office Action received for U.S. Appl. No. 15/688,337, dated Dec. 2, 2019, 13 Pages.
Wang et al., "Synthesis of Tetrammine Palladium(II) Sulfate by Ion Exchange Method," Youse Jinshu, Yellan Bufen (2016), vol. 3, pp. 59-61. (Year: 2016).
Translation of Search Report issued in corresponding Japanese Patent Application No. 2018-152210, dated Sep. 13, 2019.

* cited by examiner

DEPOSITING A STRUCTURALLY HARD, WEAR RESISTANT METAL COATING ONTO A SUBSTRATE

CROSS-REFERENCE TO RELATED APPLICATIONS

The present application is a continuation of U.S. patent application Ser. No. 15/688,337, filed Aug. 28, 2017, the entire contents of which are hereby incorporated by reference.

FIELD

The present disclosure relates generally to bonding metal to a substrate, and more particularly, to methods for preparing a substrate to be receptive to bonding a metal thereto and methods for coating a substrate.

BACKGROUND

Bonding metal to a non-conductive substrate, such as a plastic substrate, is advantageous since the resulting structure combines the properties of the metal with the properties of the plastic substrate. Unfortunately, however, metals generally do not bond well to plastics. For this reason, fasteners are sometimes used to hold metal and plastic components together. Holding metal and plastic components together using fasteners has several limitations including, but not limited to, separation caused by gaps between the components, additional weight from the fasteners, periodical fastening inspection, and managing fastener inventory.

Moreover, it is difficult to electroplate metal onto plastic components since plastics are electrical insulators. One technique for electroplating metal onto plastic components is to first electroplate a layer of copper onto a plastic component, and then apply a desired finishing metal on top of the layer of copper. But copper takes time to electroplate, can cause discoloration, and has other undesirable traits.

A need exists for a method of preparing a substrate to be receptive to bond a metal thereto. A need also exists for a method to plate a layer of metal having sufficient density to form a substrate for a second metal to be bonded.

SUMMARY

In one example, a method of coating a substrate is described. The method includes cleaning the substrate and, after cleaning the substrate, sensitizing the substrate using a sensitizing solution comprising tin chloride and hydrochloric acid. The method also includes, after sensitizing the substrate, activating the substrate in an activating solution comprising palladium chloride and hydrochloric acid. Further, the method includes subsequently neutralizing the substrate using a neutralizing solution comprising ammonium hydroxide. Still further, the method includes, after neutralizing the substrate, depositing an electroless nickel layer on the substrate.

In another example, a method of coating a substrate is described. The method includes cleaning the substrate and, after cleaning the substrate, sensitizing the substrate using a sensitizing solution comprising tin chloride and hydrochloric acid. Further, the method includes, after sensitizing the substrate, activating the substrate in an activating solution comprising palladium chloride and hydrochloric acid. Still further, the method includes subsequently neutralizing the substrate using a neutralizing solution comprising ammonium hydroxide. Still further, the method includes, after neutralizing the substrate, depositing an electroless nickel layer on the substrate, depositing an electrolytic nickel layer on top of the electroless nickel layer, and depositing an outer layer of metallic material, ceramic material, polymeric material, or any combination thereof on top of the electrolytic nickel layer.

In still another example, a method of preparing a substrate for coating is described. The method includes cleaning the substrate and, after cleaning the substrate, sensitizing the substrate using a sensitizing solution comprising tin chloride and hydrochloric acid. The method also includes, after sensitizing the substrate, activating the substrate in an activating solution comprising palladium chloride and hydrochloric acid. Further, the method includes subsequently neutralizing the substrate using a neutralizing solution comprising ammonium hydroxide.

The features, functions, and advantages that have been discussed can be achieved independently in various examples or may be combined in yet other examples further details of which can be seen with reference to the following description and figures.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying figures, wherein:

DETAILED DESCRIPTION

Figure 1:
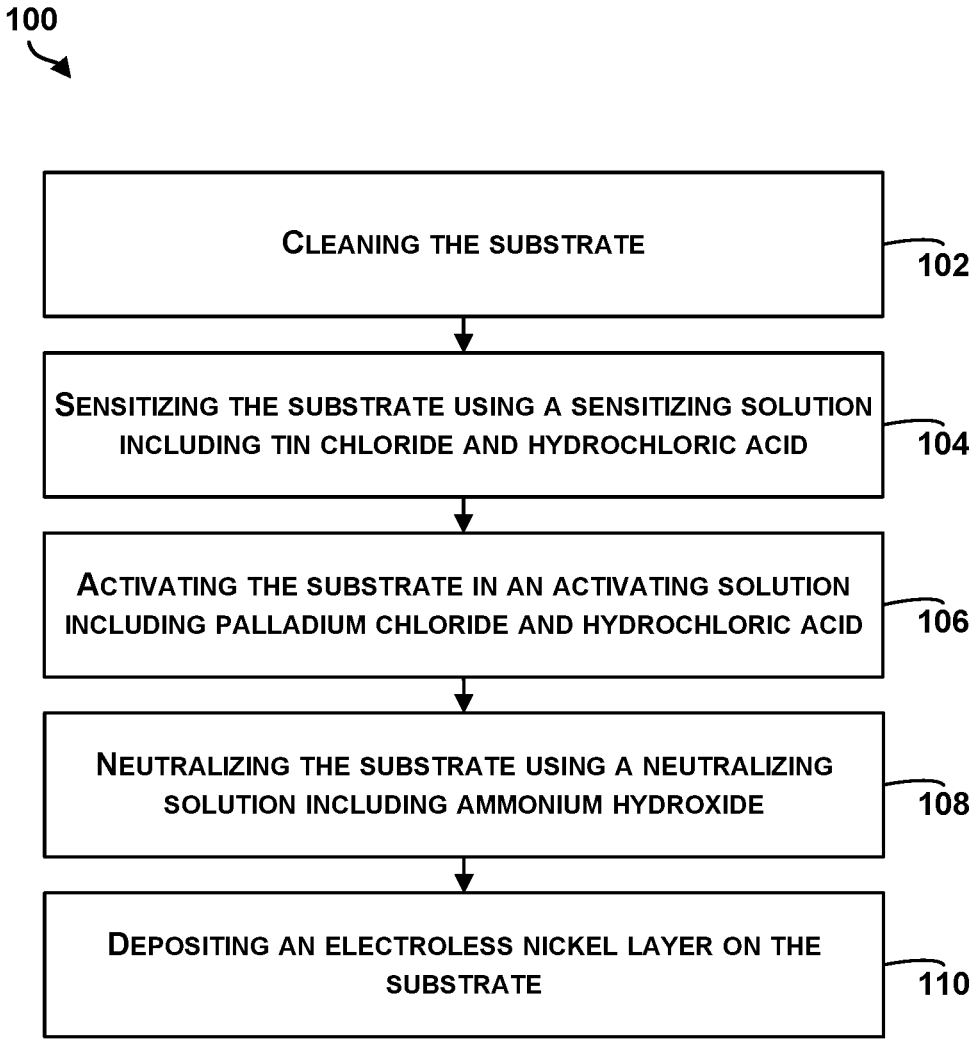
FIG. 1 shows a flowchart of an example method, according to an example.

Disclosed examples will now be described more fully hereinafter with reference to the accompanying figures, in which some, but not all of the disclosed examples are shown. Indeed, several different examples may be provided and should not be construed as limited to the examples set forth herein. Rather, these examples are provided so that this disclosure will be thorough and complete and will fully convey the scope of the disclosure to those skilled in the art.

Described herein are methods for preparing a substrate to be receptive to bonding a metal thereto and methods for coating a substrate. For instance, described herein are methods for coating a non-conductive substrate with a nickel layer, so that an outer layer can then be applied to the nickel layer. The outer layer can be an outer layer of metallic material, ceramic material, polymeric material, or a combination thereof.

An example method for preparing a substrate for coating involves cleaning the substrate and, after cleaning the substrate, sensitizing the substrate using a sensitizing solution. In some cases, the substrate can be a non-conductive substrate, such as a fiber-reinforced plastic or an engineering plastic. Engineering plastics are a group of plastic materials that have better mechanical and/or thermal properties than commodity plastics. Engineering plastic may be used as the substrate in applications where impact resistance, abrasion resistance, heat resistance, self-lubrication, and/or other properties are desirable. Other types of non-conductive substrates may also be used. An example sensitizing solution may include tin chloride and hydrochloric acid. Further, after sensitizing the substrate, the method involves activating the substrate using an activating solution and then neutralizing the substrate using a neutralizing solution. An example activating solution can include palladium chloride and hydrochloric acid. An example neutralizing solution can include ammonium hydroxide.

After the substrate has been prepared for coating, a coating can be applied to the substrate. For instance, an example method for coating the substrate can then involve depositing an electroless nickel layer on the substrate, and depositing an electrolytic nickel layer on top of the electroless nickel layer. Further, an outer layer of metallic material, ceramic material, polymeric material, or any combination thereof can be deposited on top of the electrolytic nickel layer. The composition of the outer layer may vary depending on the desired characteristics for the resulting structure. One example of an outer layer is chromium. Other example outer layers include an iron-phosphorous alloy, a nickel-cobalt-phosphorous alloy, or a cobalt-phosphorous alloy.

Advantageously, the methods presented herein allow for anchoring or attaching the nickel layer very strongly to the substrate and without undesirably impacting the substrate, so that the outer layer applied to the nickel layer can withstand strong mechanical forces without debonding or being pulled off. In other words, attaching the nickel layer very strongly to the substrate facilitates the use of subsequent processes to form a hard, corrosion-resistant layer that has good adhesion to the nickel layer, and in turn, to the substrate. Further, the methods presented herein allow for protecting, with a structural metal layer, a component featuring shapes too complex to a make a mating metal layer conforming to the component.

Substrates coated using the methods described herein may be applicable in various applications, such as in lightweight structural panels of aircrafts, aircraft fuel tanks, rotor blades, tooling surfaces for fabricating fiber-reinforced plastics, among other possible applications. Other examples of parts that may benefit from the coating methods disclosed herein include aerospace parts and non-aerospace parts such as brackets, flanges, bushings, seals, fittings, gears, nozzles, ball nuts, ball screws, fasteners, housings, and springs.

Various other features of these methods are described hereinafter with reference to the accompanying figures.

Referring now to FIG. 1, FIG. 1 shows a flowchart of an example method 100 of coating a substrate. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

In some cases, the substrate at issue can be non-conductive. For instance, the substrate can be any type of plastic material. One example plastic material is a fiber-reinforced plastic such as carbon or glass reinforced resin. Fiber-reinforced plastics are a category of composite plastics that use fiber materials to mechanically enhance the strength and stiffness of plastics. Thus, a fiber-reinforced plastic can be used as the substrate in applications where strength and stiffness are desirable. Another example plastic material is an engineering plastic. Engineering plastics are a group of plastic materials that have better mechanical and/or thermal properties than commodity plastics. One example of an engineering plastic is acrylonitrile butadiene styrene. Another example of an engineering plastic is polycarbonate. Engineering plastic can be used as the substrate in applications where impact resistance, abrasion resistance, heat resistance, self-lubrication, and/or other properties are desirable.

At block 102, the method 100 includes cleaning the substrate. When coating a substrate, the presence of grease, oil, corrosion products, dirt, or other debris affects the adherence of a deposited material to the substrate. Cleaning the substrate helps to remove grease, oil, dirt, etc. that may be present on the substrate.

Cleaning the substrate can involve sanding the substrate, either manually or using an automatic sander. Additionally or alternatively, cleaning the substrate can involve rinsing the substrate in water and acid cleaning the substrate. Acid cleaning can remove light grease, oxide films, and/or inorganic films from the substrate.

As a particular example, cleaning the substrate can involve sanding the substrate using abrasive paper, rinsing the substrate in water for one minute, immersing the substrate in a first acidic solution for five minutes, rinsing the substrate in water for one minute, immersing the substrate in a second acidic solution for ten minutes, and then rinsing the substrate in water again.

The first acidic solution can facilitate the acid cleaning. For instance, the first acidic solution can include acetone, hydroquinone, and deionized water. An example composition for the first acidic solution is 1000 ml acetone, 100 ml hydroquinone, and 25 ml cathecol.

The second acidic solution can perform the acid cleaning. For instance, the second acidic solution can be a solution including phosphoric acid, potassium dichromate, and deionized water. An example composition for the second acidic solution is 100 ml phosphoric acid, 15 g potassium dichromate, and 25 ml deionized water. In some examples, the second acidic solution can be heated to above room temperature for some time (e.g., heated to 60 degrees Celsius for ten minutes, or more or less than ten minutes).

At block 104, the method 100 includes sensitizing the substrate using a sensitizing solution including tin chloride and hydrochloric acid. For instance, the substrate can be immersed in the sensitizing solution for some time (e.g., five minutes, or more or less than five minutes). Sensitizing the substrate for some time prepares the substrate to be activated during the subsequent activating process. An example composition of the sensitizing solution is 10 g/l tin chloride, and 40 ml/l hydrochloric acid. Other compositions are also possible, such as between 5 g/l to 15 g/l of tin chloride and between 20 ml/l to 60 ml/l of hydrochloric acid.

The substrate can also be rinsed in water after the sensitization. Rinsing the substrate in water removes chemicals from the surface of the substrate.

At block 106, the method 100 includes activating the substrate in an activating solution including palladium chloride and hydrochloric acid. For instance, the substrate may be immersed in the activating solution for 10 minutes. Activating the substrate modifies the chemistry of the substrate's surface and, in turn, increases the adhesion of a subsequently applied layer to the substrate. An example composition of the activating solution is 0.5 g/l palladium chloride and 10 ml/l hydrochloric acid. Other compositions are also possible, such as between 0.25 g/l to 1.5 g/l of palladium chloride and between 5 ml/l to 30 ml/l of hydrochloric acid. In some examples, the activating solution can be heated to above room temperature for some time (e.g., heated to 90 degrees Celsius for ten minutes, or more or less than ten minutes).

The substrate may also be rinsed in water after the activation. Rinsing the substrate in water removes chemicals from the surface of the substrate.

At block 108, the method 100 includes neutralizing the substrate using a neutralizing solution including ammonium hydroxide. For instance, the substrate can be immersed in the neutralizing solution for thirty seconds. Neutralizing the substrate prevents any further activation from occurring. An example composition of the neutralizing solution is 500 cc/l of ammonium hydroxide and one liter of deionized water.

The substrate can also be rinsed in water after the neutralization. Rinsing the substrate in water removes chemicals from the surface of the substrate.

At block 110, the method 100 includes depositing an electroless nickel layer on the substrate. Depositing the electroless nickel layer on the substrate can involve immersing the substrate in a nickel bath for a number of minutes. The period of time may vary, depending on the desired thickness. The electroless nickel layer can include a nickel-phosphorous alloy or a nickel-boron alloy.

Electroless nickel has more uniform thickness, higher hardness, superior corrosion resistance, and higher lubricity as compared to electrolytic nickel. Thus, depositing an electroless nickel layer is advantageous for applications where such properties are desirable. Furthermore, cleaning, sensitizing, activating, and neutralizing the substrate as set forth above facilitates strongly anchoring the electroless nickel layer to the substrate without damaging the substrate.

In one example, a portion of the blocks of the method 100 can be performed in order to prepare a substrate for coating. For instance, the functions at blocks 102, 104, 106, and 108 can be performed without performing the function at block 110. In this manner, the substrate can be prepared for coating during a first time period, and then subsequently stored for coating at a later time. An example method of preparing the substrate can therefore involve cleaning the substrate and, after cleaning the substrate, sensitizing the substrate using a sensitizing solution including tin chloride and hydrochloric acid. Further, the method can involve, after sensitizing the substrate, activating the substrate in an activating solution including palladium chloride and hydrochloric acid. Still further, the method can involve subsequently neutralizing the substrate using a neutralizing solution including ammonium hydroxide.

Figure 2:
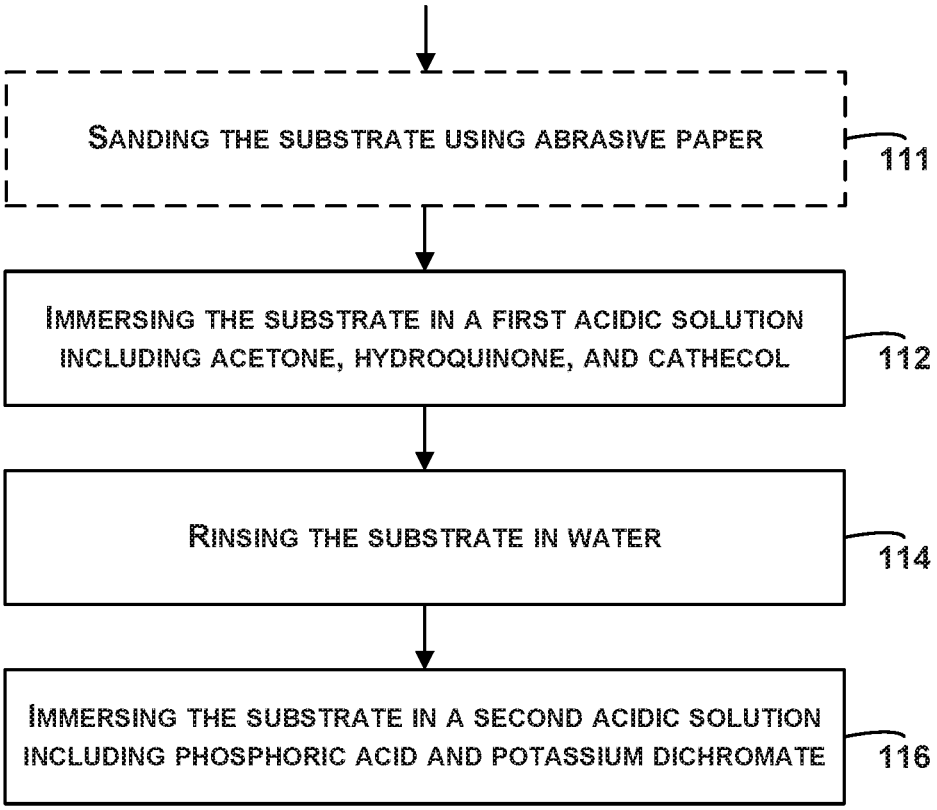
FIG. 2 shows a flowchart of another example method for use with the method shown in FIG. 1, according to an example.

FIG. 2 shows a flowchart of another example method for use with the method 100 shown in FIG. 1, according to an example. At block 111, functions can include sanding the substrate using abrasive paper. At block 112, functions include immersing the substrate in a first acidic solution comprising acetone, hydroquinone, and cathecol. At block 114, functions include rinsing the substrate in water. And at block 116, functions include immersing the substrate in a second acidic solution including phosphoric acid and potassium dichromate. The functions at blocks 111, 112, 114, and 116 can occur, for example, at block 102 of FIG. 1 (i.e., as part of cleaning the substrate).

In line with the discussion above, an example composition for the first acidic solution is 1000 ml acetone, 100 ml hydroquinone, and 25 ml cathecol. Further, an example composition for the second acidic solution is 100 ml phosphoric acid, 15 g potassium dichromate, and 25 ml deionized water.

Figure 3:
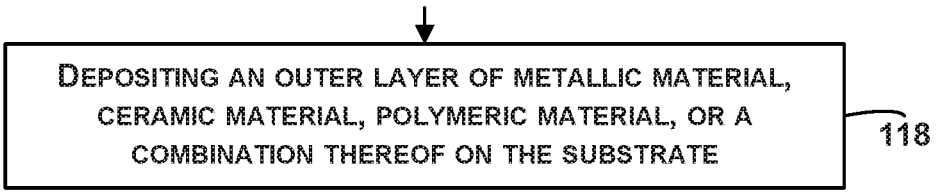
FIG. 3 shows a flowchart of another example method for use with the method shown in FIG. 1, according to an example.

FIG. 3 shows a flowchart of another example method for use with the method 100 shown in FIG. 1, according to an example. At block 118, functions include depositing an outer layer of metallic material, ceramic material, polymeric material, or a combination thereof on the substrate. The function at block 118 can occur, for example, after the function at block 110 of FIG. 1 (i.e. after depositing an electroless nickel layer on the substrate).

The outer layer can be deposited by using electroplating or any suitable coating process. The material chosen for the outer layer may vary depending on the desired characteristics for the resulting structure.

For instance, in one example, the outer layer can be an iron-phosphorous alloy with 1-6 wt % (or another percent by weight) phosphorous produced by electroplating. The outer layer can be followed by electrodeposition of a topcoat of tin of a few microns thickness. Together, the outer layer and the topcoat can yield a surface that has low friction, high hardness, excellent resistance against adhesive wear, and good ability to retain lubricants.

In another example, the outer layer can be an electroless nickel layer (e.g., a nickel-phosphorous compound with phosphorous content in the 5-12 wt % range or another range). This outer layer can have a hardness varying from 500 HV to 1000 HV.

In another example, the outer layer may be a nickel-cobalt-phosphorous alloy applied using electroplating and incorporating silicon carbide particles with thickness from about 0.3 to about 30 mil (or other thickness) and hardness of 600-700 HV (or other hardness). This outer layer can be particularly suitable where wear resistance and corrosion protection are desired.

In still another example, the outer layer can be a cobalt-phosphorous alloy applied using electroplating and having a thickness from about 0.3 to about 30 mil and hardness of 600-700 HV. This outer layer can be tailored to exhibit a combination of low friction and low wear. Alternatively, this outer layer could contain silicon carbide particles in order to increase abrasion resistance.

In still another example, the outer layer may be chromium applied using chrome plating. Chromium coatings provide an overall service performance comparable to the other materials for outer layers mentioned herein above. Chromium, however, is less environmentally desirable than other materials for outer layers.

Figure 4:
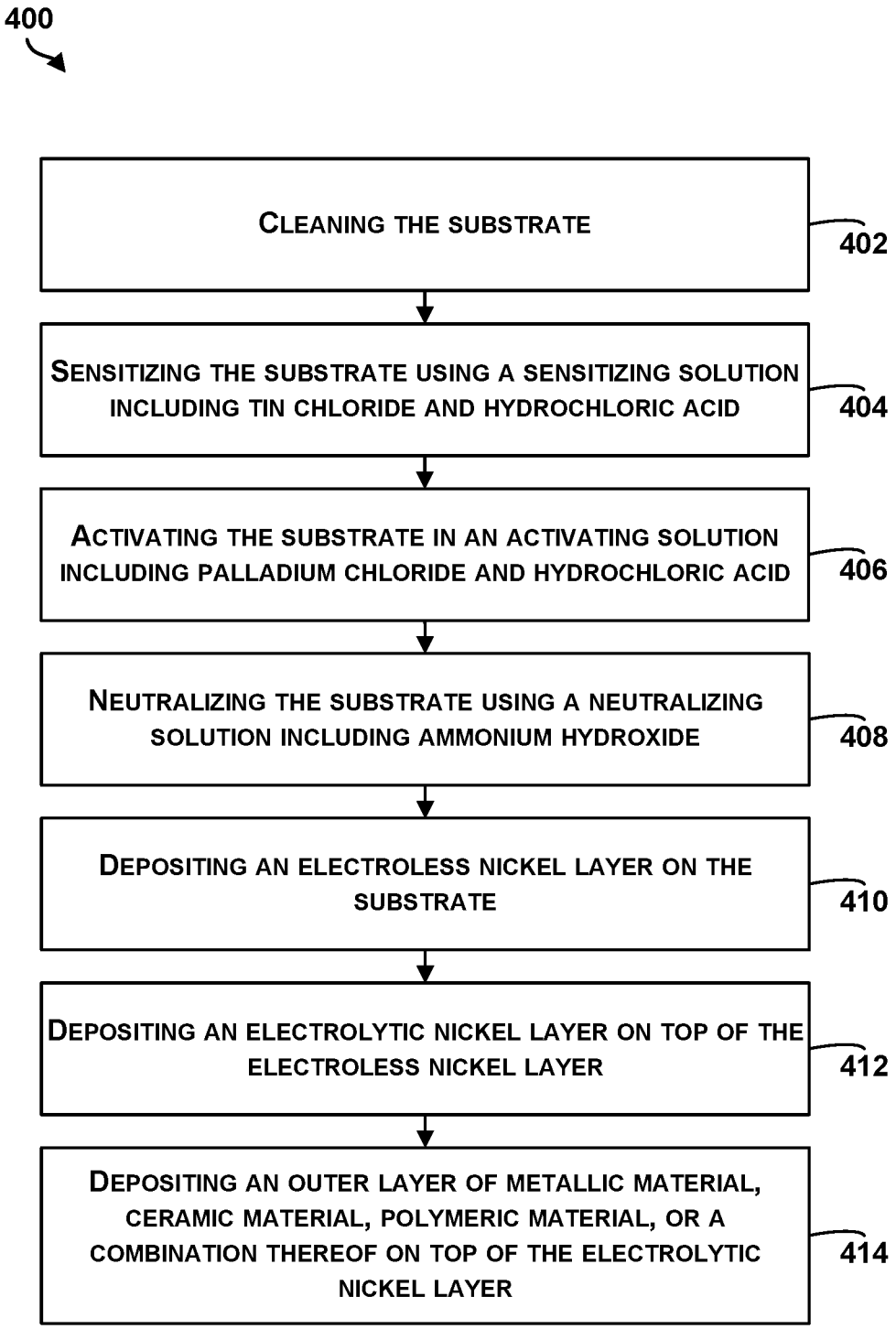
FIG. 4 shows a flowchart of another example method, according to an example.

FIG. 4 shows a flowchart of another example method 400 of coating a substrate, according to an example. Like the method 100 of FIG. 1, at block 402, the method 400 includes cleaning the substrate and, at block 404, the method 400 includes sensitizing the substrate using a sensitizing solution including tin chloride and hydrochloric acid. Further, like the method 100 of FIG. 1, at block 406, the method 400 includes activating the substrate in an activating solution including palladium chloride an hydrochloric acid, at block 408, the method 400 includes neutralizing the substrate using a neutralizing solution including ammonium hydroxide and, at block 410, the method 400 includes depositing an electroless nickel layer on the substrate. The examples described above with respect to the method 100 of FIG. 1 are equally applicable to the corresponding functions at blocks 402, 404, 406, 408, and 410 of the method 400.

Unlike the method 100 of FIG. 1, at block 412, the method 400 includes depositing an electrolytic nickel layer on top of the electroless nickel layer. Depositing the electrolytic nickel layer can involve connecting a battery or other power supply to the substrate that acts as a negative electrode (cathode) and to a solid source (e.g., a bar) of nickel that acts as a positive electrode (anode), and immersing the substrate and the solid source in an electrolyte (e.g., a nickel solution). As electric current passes through the electrolyte, positive nickel ions form in the electrolyte. The positive nickel ions then deposit on top of the electroless nickel layer.

Electrolytic nickel is more ductile than electroless nickel, which tends to be brittle and glasslike. Hence, adding an electrolytic nickel layer on top of the electroless nickel layer improves the strength and durability of the substrate. Further, deposition rates of electrolytic nickel are higher than electroless nickel. Thus, depositing electroless nickel first and then switching to depositing electrolytic nickel facilitates depositing nickel on the substrate faster as compared to only depositing electroless nickel.

At block 414, the method 400 includes depositing an outer layer of metallic material, ceramic material, polymeric material, or a combination thereof on top of the electrolytic nickel layer. The function at block 414 is similar to the function at block 412 of the method 100 of FIG. 1. Hence, the examples described above with respect to block 112 of the method 100 of FIG. 1 are equally applicable to the function at block 414 of the method 400. For instance, the outer layer of metallic material can be an iron-phosphorous alloy, an electroless nickel layer, a nickel-cobalt-phosphorous alloy incorporating silicon carbide particles, a cobalt-phosphorous alloy, or chromium.

When compared to existing solutions, coatings produced using the method 400 possess several advantages. For instance, the resulting coatings exhibit a lack of porosity, imparting high mechanical properties to the coating layers. Further, the resulting coatings exhibit elasticity, allowing the coating to stretch under applied thermal or mechanical stress without breaking. The resulting coatings also exhibit perfect conformation to substrate geometry and resistance to ultraviolet rays.

In an experiment, an example 150 micrometer coating applied to a fiber-reinforced plastic substrate using the method 400, the example coating adhered better to the fiber-reinforced plastic substrate than a coating applied using a galvanic process and three coatings applied using various spraying processes. Further, the example coating featured the lowest wear rate, lowest porosity, highest microhardness, and highest shear strength.

One of ordinary skill in the art, after reading this disclosure, will also appreciate that the functions at blocks 111, 112, 114, and 116 of FIG. 2 may also be used with the method 400 of FIG. 4. For instance, the functions at blocks 111, 112, 114, and 116 of FIG. 2 may occur at block 402 of FIG. 4 (i.e., as part of cleaning the substrate).

Figure 5:
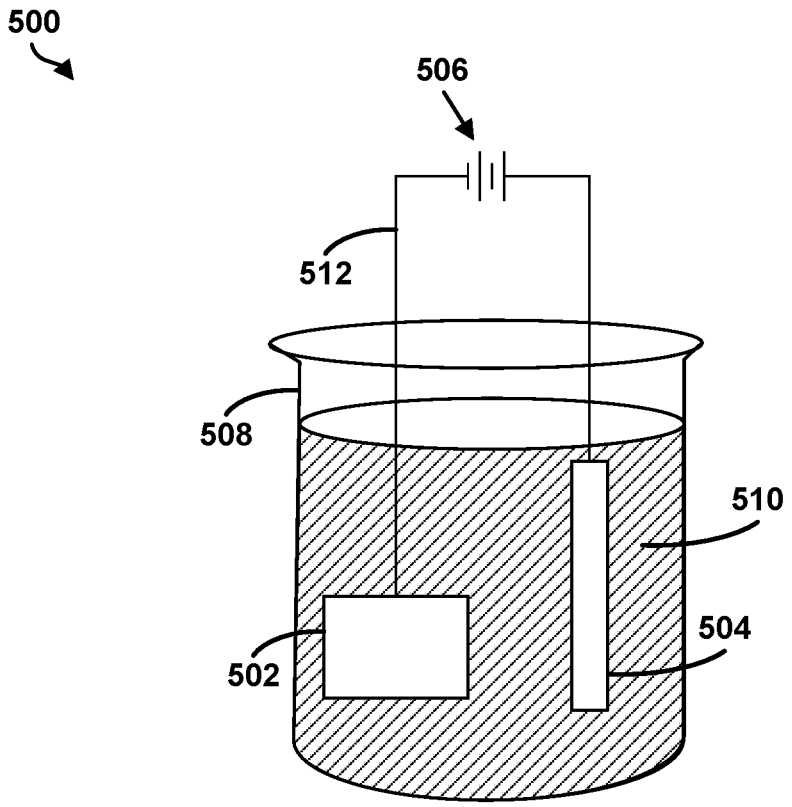
FIG. 5 illustrates an example system for electrolytic nickel plating, according to an example.

FIG. 5 illustrates an example system 500 for electrolytic nickel plating, according to an example. As shown in FIG. 5, the example system 500 includes an anode 502, a substrate 504, a source of electrical power 506, a container 508, an electrolyte 510, and electrically conductive wires 512. The anode 502 contains the metal material to be deposited, such as nickel. The substrate 504 may be a non-conductive substrate having an electroless nickel layer (e.g., top layer). As such, the substrate may act as a cathode. Both the anode 502 and the substrate 504 are electrically connected to the source or electrical power 506, which may be a battery or other source of electrical power, via the electrically conductive wires 512. The container 508 is partially filled with the electrolyte 510, which may be a nickel solution.

In operation, the anode 502 and the substrate 504 are immersed in the electrolyte 510, and electric current is passed through the electrolyte 510, causing metal ions to be deposited on the substrate 504.

Figure 6:
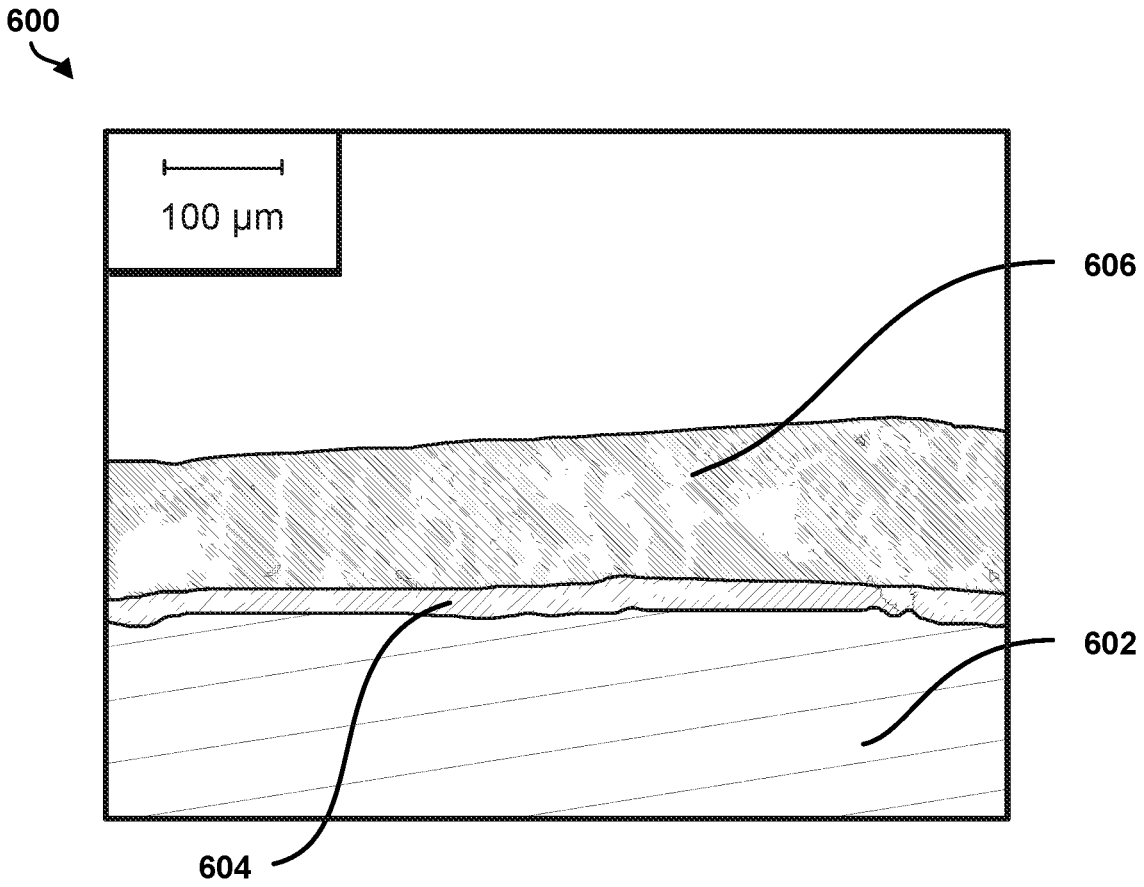
FIG. 6 shows a cross-sectional view of an example coating on a substrate, according to an example.

FIG. 6 shows a cross-sectional view 600 of an example coating on a fiber-reinforced plastic substrate 602. A nickel layer 604 is shown on top of the fiber-reinforced plastic substrate 602. Further, a chromium layer 606 is shown on top of the nickel layer 604.

Figure 7:
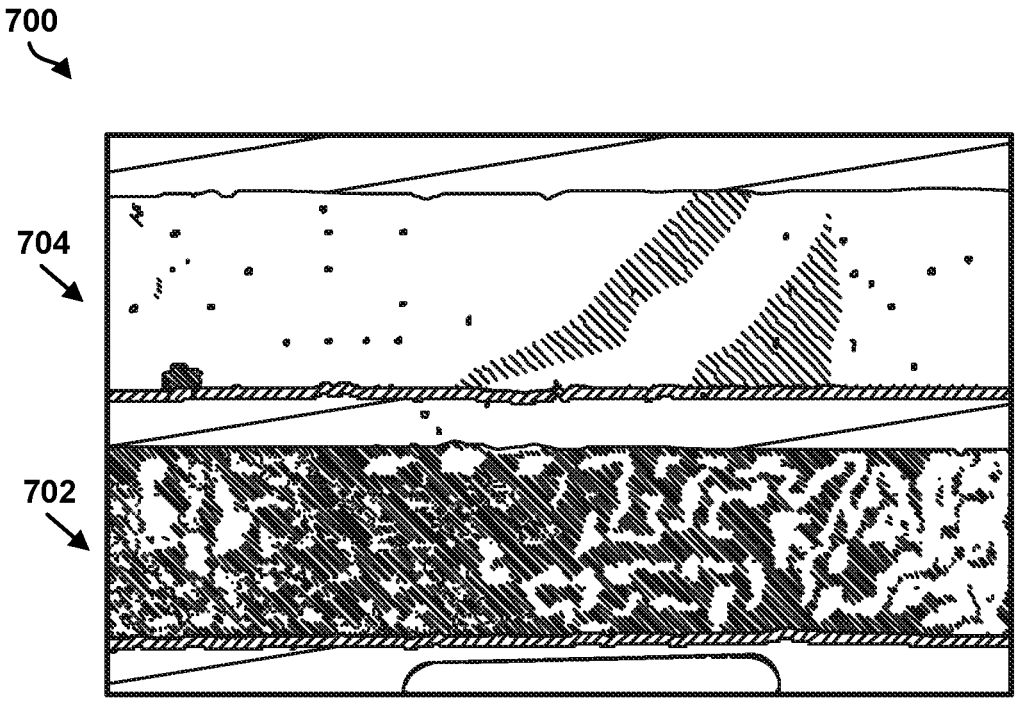
FIG. 7 shows a top view of the example coating shown in FIG. 6, according to an example.

FIG. 7 shows a top view 700 of the example coating shown in FIG. 6, according to an example. Specifically, FIG. 7 shows a first portion 702 of the chromium layer 606 of FIG. 6 as deposited and a second portion 704 of the chromium layer 606 of FIG. 6 that has been grinded to smooth out the chromium layer. As evidenced by the appearance of the top portion 704, the bonding strength of the chromium layer 606 is sufficient to withstand grinding of the chromium layer 606 without the chromium layer 606 debonding from the fiber-reinforced substrate.

The description of the different advantageous arrangements has been presented for purposes of illustration and description, and is not intended to be exhaustive or limited to the examples in the form disclosed. After reviewing and understanding the foregoing disclosure, many modifications and variations will be apparent to those of ordinary skill in the art. Further, different examples may provide different advantages as compared to other examples. The example or examples selected are chosen and described in order to best explain the principles, the practical application, and to enable others of ordinary skill in the art to understand the disclosure for various examples with various modifications as are suited to the particular use contemplated.

What is claimed is:

1. A method of coating a substrate, the method comprising:

cleaning the substrate, wherein cleaning the substrate comprises sanding the substrate using abrasive paper and immersing the substrate in an acidic solution comprising acetone, hydroquinone, and catechol;

after cleaning the substrate, sensitizing the substrate using a sensitizing solution comprising tin chloride and hydrochloric acid;

after sensitizing the substrate, activating the substrate in an activating solution comprising palladium chloride and hydrochloric acid;

subsequently neutralizing the substrate using a neutralizing solution comprising ammonium hydroxide;

after neutralizing the substrate, providing an electroless nickel layer on the substrate using electroless deposition;

depositing, using an electric current, an electrolytic nickel layer on top of the electroless nickel layer; and depositing an outer layer on top of the electrolytic nickel layer, wherein the outer layer comprises a metallic material, a ceramic material, a polymeric material, or any combination thereof.

2. The method of claim 1, wherein the substrate is non-conductive.

3. The method of claim 2, wherein the substrate comprises a fiber-reinforced plastic.

4. The method of claim 1, wherein the substrate comprises an engineering plastic.

5. The method of claim 1, wherein the sensitizing solution comprises between 5 g/l to 15 g/l of tin chloride and between 20 ml/l to 60 ml/l of hydrochloric acid.

6. The method of claim 1, wherein the activating solution comprises between 0.25 g/l to 1.5 g/l of palladium chloride and between 5 ml/l to 30 ml/l of hydrochloric acid.

7. The method of claim 1, wherein cleaning the substrate further comprises immersing the substrate in an acidic solution comprising phosphoric acid and potassium dichromate.

8. The method of claim 7, further comprising heating the acidic solution comprising phosphoric acid and potassium dichromate prior to immersing the substrate in the acidic solution comprising phosphoric acid and potassium dichromate.

9. The method of claim 7, wherein immersing the substrate in the acidic solution comprising acetone, hydroquinone, and catechol facilitates an acid cleaning, and immersing the substrate in the acidic solution comprising phosphoric acid and potassium dichromate performs the acid cleaning.

10. The method of claim 9, wherein cleaning the substrate further comprises rinsing the substrate in water prior to immersing the substrate in the acidic solution comprising phosphoric acid and potassium dichromate.

11. The method of claim 10, further comprising heating the acidic solution comprising phosphoric acid and potassium dichromate prior to immersing the substrate in the acidic solution comprising phosphoric acid and potassium dichromate.

12. The method of claim 1, wherein the metallic material is an iron-phosphorous alloy.

13. The method of claim 1, wherein the metallic material is a nickel-cobalt-phosphorous alloy.

14. The method of claim 1, wherein the metallic material is a cobalt-phosphorous alloy.

15. The method of claim 1, wherein the metallic material is chromium.

16. The method of claim 1, further comprising heating the activating solution prior to activating the substrate.

17. The method of claim 1, wherein providing the electroless nickel layer comprises immersing the neutralized substrate in a nickel bath.

18. A method of coating a substrate, the method comprising:

cleaning the substrate;

after cleaning the substrate, sensitizing the substrate using a sensitizing solution comprising tin chloride and hydrochloric acid;

after sensitizing the substrate, activating the substrate in an activating solution comprising palladium chloride and hydrochloric acid;

subsequently neutralizing the substrate using a neutralizing solution comprising ammonium hydroxide;

after neutralizing the substrate, providing an electroless nickel layer on the substrate using electroless deposition;

depositing, using an electric current, an electrolytic nickel layer on top of the electroless nickel layer; and depositing an outer layer on top of the electrolytic nickel layer, wherein the outer layer comprises an iron-phosphorous alloy.

19. The method of claim 18, wherein the substrate is non-conductive.

20. The method of claim 19, wherein the substrate comprises a fiber-reinforced plastic.

* * * * *